US009644377B1

(12) United States Patent
Massotte

(10) Patent No.: US 9,644,377 B1
(45) Date of Patent: May 9, 2017

(54) SCREED GUIDE/CONTROL JOINT AND MOUNTING CLIP

(71) Applicant: OMNIPLAST, Villeron (FR)

(72) Inventor: Laurent Jean-Baptiste Massotte, Bruguieres (FR)

(73) Assignee: OMNIPLAST, Villeron (FR)

( * ) Notice: Subject to any disclaimer, the term of this patent is extended or adjusted under 35 U.S.C. 154(b) by 0 days.

(21) Appl. No.: 14/756,830

(22) Filed: Oct. 21, 2015

Related U.S. Application Data

(60) Provisional application No. 62/176,453, filed on Feb. 20, 2015.

(51) Int. Cl.

| | |
|---|---|
| ***E04H 12/00*** | (2006.01) |
| ***E04F 15/14*** | (2006.01) |
| ***E04G 15/00*** | (2006.01) |
| ***E01C 11/06*** | (2006.01) |
| ***E04B 1/68*** | (2006.01) |
| ***E04C 5/16*** | (2006.01) |

(52) U.S. Cl.
CPC ..... *E04F 15/14* (2013.01); *E01C 11/06* (2013.01); *E04B 1/68* (2013.01); *E04C 5/168* (2013.01); *E04G 15/00* (2013.01)

(58) Field of Classification Search
CPC ..... E04F 15/14; E01C 11/06; E01C 11/106; E04B 1/68; E04B 1/4114; E04C 5/168; E04G 15/00; E04G 21/10; F16B 9/023; F16B 9/026; F16B 5/068
See application file for complete search history.

(56) References Cited

U.S. PATENT DOCUMENTS

| | | | | |
|---|---|---|---|---|
| 1,789,576 | A * | 1/1931 | Bowman | E04F 15/14 52/318 |
| 4,669,245 | A * | 6/1987 | Lucas | E04F 15/14 52/318 |
| 4,906,129 | A * | 3/1990 | Stegmeier | E04F 15/14 404/64 |
| 6,866,445 | B2 * | 3/2005 | Semler | E01C 23/01 404/119 |
| 2007/0256380 | A1 * | 11/2007 | Toffolo | E01C 11/106 52/396.06 |
| 2014/0150356 | A1 * | 6/2014 | Reed | E04B 1/4114 52/126.7 |

* cited by examiner

*Primary Examiner* — Brian Mattei
(74) *Attorney, Agent, or Firm* — Young & Thompson

(57) ABSTRACT

An improved screed guide/control joint and clip for the placement of concrete in concrete slabs on a plurality of different surfaces, the clip accommodating different sized screed guides to accommodate different depths of concrete pours, the screed guide/control joint inhibiting water passage, impeding growth of weeds in the joint, and having improved lateral flexibility to the expansion and contraction of the concrete, the screed guide also allowing placement of conduits within the cover portion of the channel cavity of the screed guide.

12 Claims, 9 Drawing Sheets

SCREED GUIDE/CONTROL JOINT AND MOUNTING CLIP

RELATED APPLICATIONS

Applicant claims the benefit of provisional application Ser. No. 62/176,453, filed Feb. 20, 2015.

BACKGROUND OF THE INVENTION

1. Field of the Invention

The present invention relates to an improved screed guide/control joint and clip, which are utilized in the placement of concrete in concrete slabs and establishing control joints, the screed guide/control joints providing precise placement of the concrete in concrete slabs and its leveling.

2. Description of the Prior Art

The pouring and use of concrete is a fundamental construction task in the trade. It is referred to as the placement of concrete. It is often required in the installation of sidewalks. It is placed over steel decks to provide the flooring base for multi-story skyscrapers; it is placed for the flooring of large warehouse or industrial structures; and it is placed to form the basis for water retention basins and reservoirs. It further provides the basis for highway surfaces and airport runways.

There are two essential joints associated with concrete slabs. The first joint is commonly referred to as the expansion joint and passes completely through the concrete slab. The expansion joint is designed to allow for the expansion and contraction of the concrete slab in response to ambient temperature conditions. The second joint is commonly referred to as the control joint. The control joint is a linear impression formed in the concrete slab after its placement. It does not extend through the concrete slab. The purpose of the control joint is to control the direction of any cracking which may appear in the slab over time. Typical control joints would run transversely on the slab from one edge to the other. Control joints would normally be formed by dragging a trowel across the poured concrete while it was still wet to form the linear impression, and in some instances, diamond saws would be used to form the control joints after the concrete slab had hardened.

In the prior art, any handy material would be utilized to form the peripheral outline or frame of the concrete slab and any associated expansion joints. The concrete would be placed within the frame and leveled using a screed or squeegee-like rake, which would be dragged across the surface of the wet concrete while resting on at least two adjacent or abutting framing members in order to achieve a planar level slab. The framing members upon which the screed rested while leveling the surface of the concrete slab are referred to in the trade as screed guides, and the screed guide and its mount are commonly referred to as screed guide/control joints.

European building codes require a ten year guarantee with respect to poured concrete slabs. No such guarantee is yet required or exists in US building codes. This dichotomy has led to greater technical advances in Europe with respect to the pouring of concrete slabs. In particular, a screed guide profile has been developed in which the screed guide itself also forms the control joint for the concrete slab. The use of these combination screed guide/control joints presents some great advantages in the area of placement of concrete slabs and in the life expectancy of the concrete slabs. However, the accurate placement of the screed guide/control joints sometimes proved laborious and time consuming, and do not address all of the problems associated therewith.

Initially, some screed guide/control joints were positioned by pouring small mounds of concrete in a desired linear direction before positioning of the screed guide/control joint. The screed guide/control joint would then be positioned on the small mounds of concrete to the desired height, and the mounds of concrete would be allowed to set. Once the mounds of concrete had set, securing the screed guide/control joint, the concrete slab would be poured to the height of the upper edge of the screed guide/control joint. This method became laborious and time consuming since normally 24 hours would have to elapse from the time that the mounds of concrete were poured until the time that the slab could be poured to allow for the mounds to set and position the screed guide/control joint.

The method of installing screed guide/control joints evolved to the use of rebar stakes, and clips. The section of rebar would be pounded into the ground to an estimated height, each rebar being positioned approximately two feet apart. Clips would then be installed on the top of the rebar, the upper portion of such clips presenting a dove tail channel into which a preformed plastic screed guide/control joints having a pyramidal cross section would snap fit. The worker would hand adjust the depth of the rebar in order that the clips were at the same height so that the screed guide/control joint presented a level upper edge for placement of the concrete slab. This method presents problems when a vapor barrier is utilized, since the rebar stakes will pierce the plastic sheets or other types of vapor barriers and degrade their performance. It also presents a problem when concrete flooring is being placed on a steel deck as is done in the construction of multi-story buildings or skyscrapers. The rebar stake cannot be driven into or through the steel deck.

An additional problem is presented in those instances where concrete slabs are being placed onto compacted gravel subgrade or ground. Some installations call for void forms to be placed beneath the concrete slab at various locations to compensate for the expansion and contraction of the ground due to expansion and contracting soil conditions. These voided areas are formed utilizing cardboard housings which are positioned prior to the placement of the concrete slab, the slab being placed essentially over the cardboard encapsulating the cardboard housing between the concrete and the ground. The void area under the cardboard housing and in contact with the ground provides compensation for expansion and contraction of the ground. The cardboard housing over time will eventually deteriorate, but the void will remain. The use of the rebar stakes or any stake on such a slab would pierce the cardboard housing and obviate its desired purpose of forming a void between the poured concrete and the ground.

An additional problem associated with the current installation of screed guide/control joints is that the profile of the screed guide/control joint varies depending on the thickness of the concrete slab. Two sizes of screed guide/control joint profiles are currently used for screed guide/control joint placement in various thicknesses of concrete slabs. A large profile screed guide/control joint is utilized for placement of six inches or greater, and a small profile screed guide/control joint is used for placements of lesser thickness. Since the size of the screed guide/control joints vary, the installer must inventory a quantity of clips that will fit the two profiles.

U.S. Pat. No. 8,925,259 to Reed addressed the aforesaid problems and set forth a system which overcomes the problems and disadvantages of the prior art in allowing for the accurate placement and adjustment of screed guide control joints and the elimination of multiple sizes. Applicant in this application has improved the screed guide control joint profile to further improve the pouring of concrete slabs, and to extend their life expectancy.

OBJECTS OF THE INVENTION

An object of the present invention is to provide an improved screed guide/control joint and clip to accelerate and facilitate the accurate placement of the screed guides of various sizes to accommodate concrete slabs of various thickness.

A further object of the present invention is to provide for an improved screed guide/control joint and clip which allows for the facile and exact adjustment of the height of the screed guide/control joint.

A still further object of the present invention is to provide for an improved screed guide/control joint and clip, the profile of which will provide better adherence to the surrounding poured concrete and improve lateral flexibility with the expansion and contraction of the concrete.

A still further object of the present invention is to provide for an improved screed guide/control joint and clip having a profile which will act as a water stop function to impede the growth of weeds or other plant growth in the control joints.

A still further object of the present invention is to provide for an improved screed guide/control joint and clip in which the upper interior cell of the profile is formed with protruding frictionalized tabs designed to frictionally engage different sized steel rods or rebar used to butt join, abutting ends of screed guide/control joint joints.

A still further object of the present invention is to provide for an improved screed guide/control joint and clip having a large empty lower cell of the profile which can be used as a conduit for electrical or fluid conduits.

SUMMARY OF THE INVENTION

An improved screed guide/control joint and clip for the placement of concrete in concrete slabs on a plurality of different surfaces, the clip accommodating different sized screed guides to accommodate different depths of concrete pours, the screed guide/control joint inhibiting water passage, impeding growth of weeds in the joint, and having improved lateral flexibility to the expansion and contraction of the concrete, the screed guide also allowing placement of conduits within the cover portion of the channel cavity of the screed guide.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
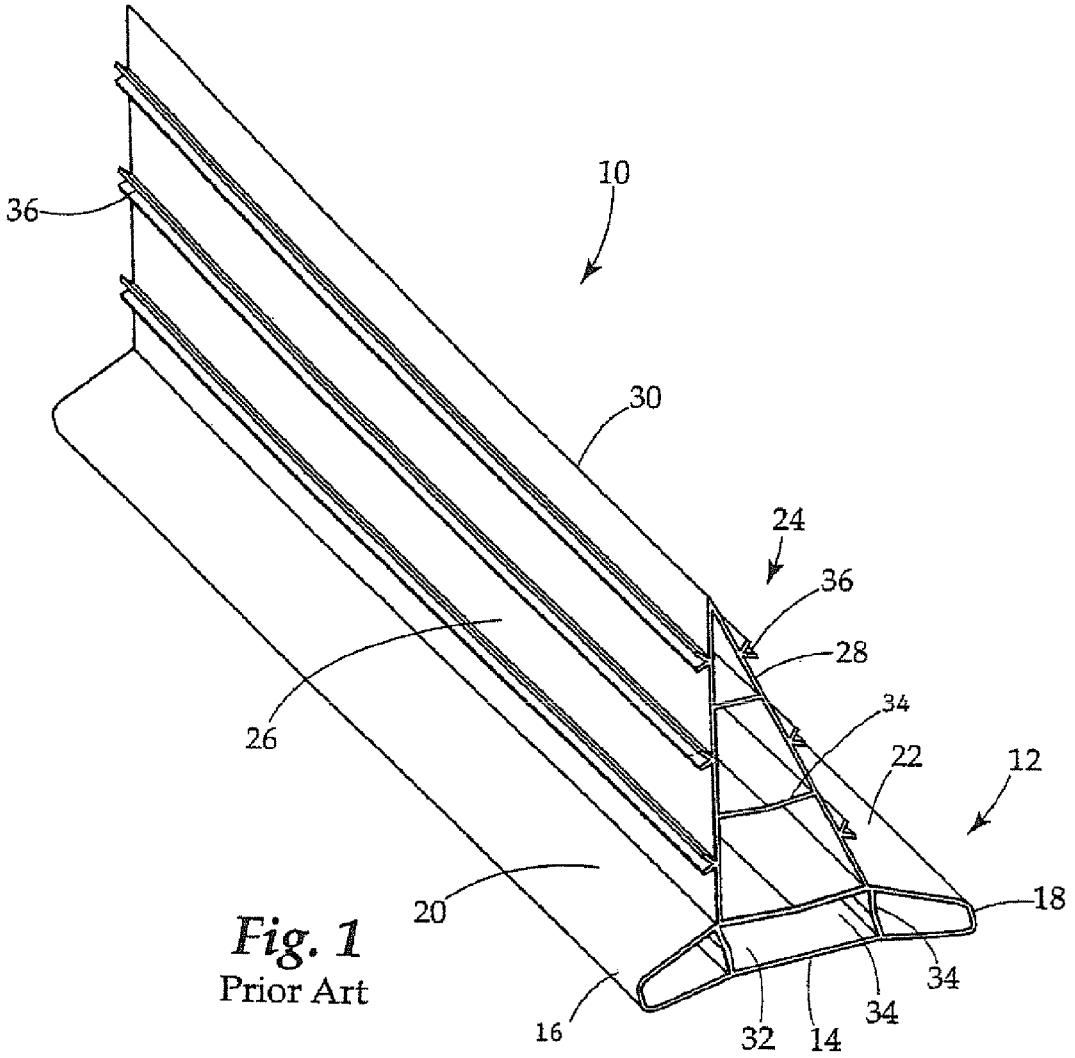
Fig. 1 Prior Art
FIG. 1 is a perspective view of a typical screed guide/control joint of the prior art.

FIG. 1 is a perspective view of a screed guide of the prior art used to form a screed guide/control joint. The screed guide 10 is linear in shape generally coming in 12 to 16 foot lengths to be cut in the field to the desired length required. It is formed of extruded polymer and has a base portion 12 comprised of a planar bottom wall 14, two opposing side walls 16 and 18, angled upper walls 20 and 22 terminating in an upwardly extending tower portion 24, triangular in cross section formed by two angled side walls 26 and 28 and terminating in an apex which forms the upper edge 30 of screed guide 10. The interior of the base and tower portions are formed during the extrusion process with cross member ribs 34 for support. Additionally, the angled side walls 26 and 28 of tower portion 24 may also be formed with longitudinal parallel ribs 36 to aid in the setting process when screed guide 10 is encapsulated in concrete.

In most instances, the bottom wall 14 of the base member is slightly flared downwardly at its side walls 16 and 18 defining rigid enclosed longitudinal channels to aid in its snap fitting with a screed guide/control joint clip as described hereafter.

It should be noted that screed guides generally are formed in two sizes, large profile and small profile. The small profile screed guide is used to form screed guide/control joints in concrete slabs up to six inches in depth, and a large profile screed guide is used for slabs in excess of six inches in depth. A typical large profile screed guide would have a base portion with slightly over two inches wide and a tower portion height of approximately three to three and a half inches, whereas the small profile screed guide dimensions would be approximately half those of the large profile screed guide.

Figure 2:
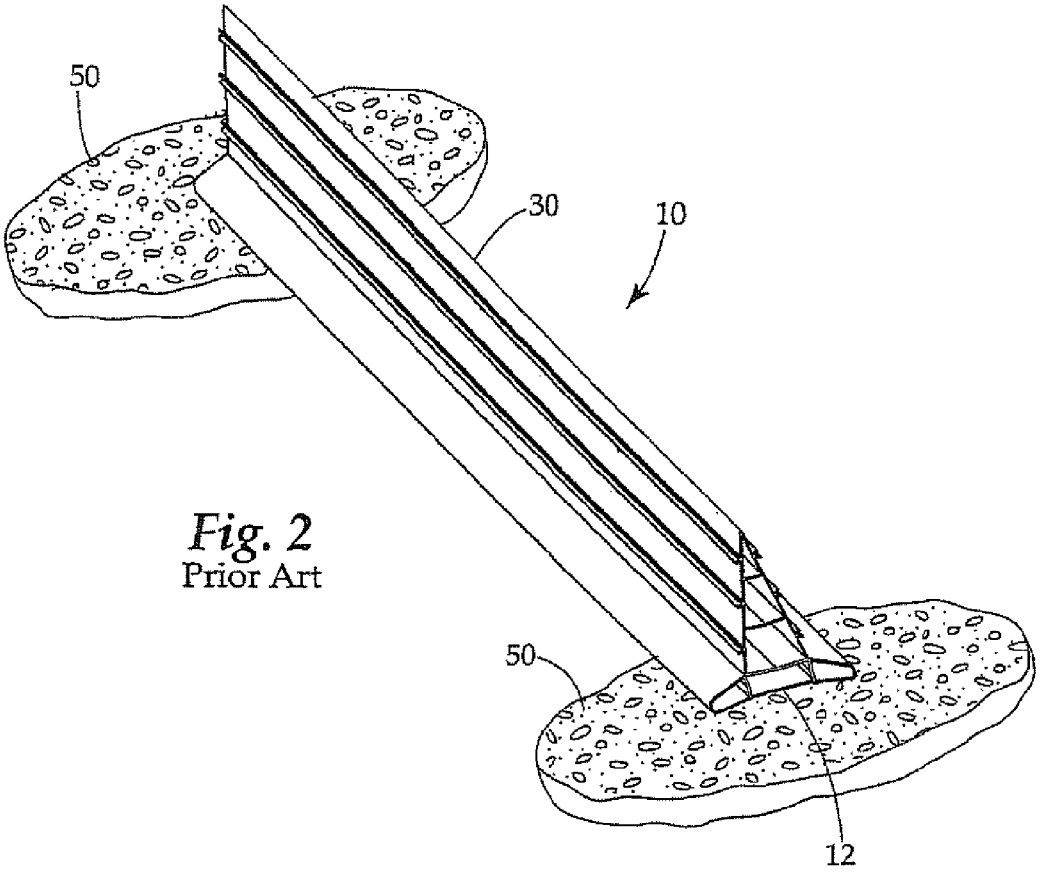
Fig. 2 Prior Art
FIG. 2 is a perspective view of the screed guide/control joint of FIG. 1 illustrating a prior art method of installation.

FIG. 2 is a perspective view of screed guide 10 of FIG. 1 illustrating its setting with respect to a prior art method of installation to form a screed guide/control joint. In this method of installation, small mounds of concrete 50 are poured in a linear orientation approximately two feet apart so that the base portion 12 of the screed guide may be set on these concrete mounds and the mounds allowed to harden and secure the screed guide/control joint. Once set, the concrete slab would be placed, encapsulating the entire length of the screed guide/control joint to the height of its upper edge 30. Depending upon the area of concrete to be placed, a plurality of screed guide/control joints would be set in this manner, the desired distance apart in accordance with code, in order to define the area of concrete to be placed. This method of setting the screed guide/control joint is very time consuming, laborious, and requires exacting measurements to ensure that upper edge 30 is at a consistent height along the length of the screed guide/control joint and on all similarly situated screed guide/control joints.

The desire is to obtain a concrete slab of some dimension which has a uniform planar upper surface. To that end, the initial concrete mounds 50 that are placed must be of the desired height and the screed guide must be set at the accurate height, as well as all parallel and abutting screed guide/control joints to insure that the upper edge 30 of all of the screed guide/control joints utilized to define the concrete slab are at the same height. This can best be described as a hit or miss method of obtaining a uniform planar concrete slab.

Figure 3:
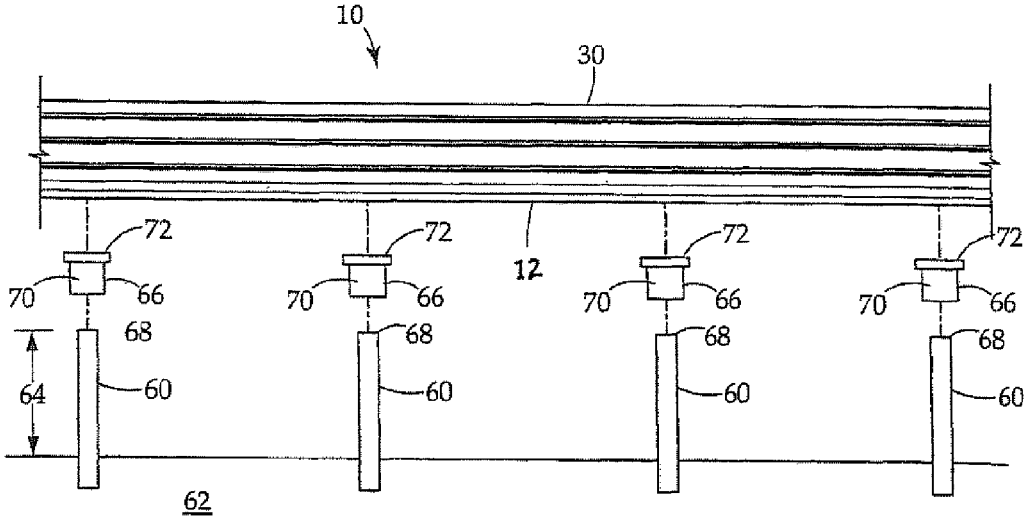
Fig. 3 Prior Art
FIG. 3 is an exploded perspective view of the screed guide/control joint of FIG. 1 and a second prior art method of installation.

FIG. 3 is an exploded perspective view of the screed guide of FIG. 1 and an alternative method for installation developed in the prior art. In this configuration a plurality of lengths of rebar 60 are driven into the underlying substrate 62 to a desired height 64. The rebar is installed in a linear orientation approximately two feet apart. A screed guide/control joint clip 66 is then frictionally positioned on the upper extended end 68 of the rebar 60. The screed guide/control joint clip 66 comprises a tubular base 70 which slidably engages the upper end 68 of the rebar 60. Unitarily formed to the upper end of tubular base 70 is a single dove tail channel 72. Dove tail channel 72 is dimensioned to the width of the base portion 12 of screed guide 10.

The installer would adjust the height of the sections of rebar 60 by hand to insure that the screed guide/control joint clips 66 were all at the same height. The screed guide would then be snap fit into the dove tail channel 72 of the screed guide/control joint clip, thus securing the screed guide/control joint at a desired height above the substrate 62. The installer would take measurements to insure that the upper edge 30 of all screed guides 10 utilized and placed in order to place the concrete slab were all at the same height. The concrete would then be poured encapsulating the rebar 60, the screed guide/control joint clip 66 and the screed guide/control joint 10 to the height of its upper edge 30. Sections of the concrete slab would be poured in succession between each screed guide/control joint so positioned.

This method, while an improvement over the use of small poured concrete mounds, still required checking by the installer to insure that the upper edges 30 of all of the screed guide/control joints 10 were at the same level, and required multiple adjustments of the height of the rebar, since the screed guide/control joint would not snap fit and lock into the dove tail channel 72 of the screed guide/control joint clip 66 unless all screed guide/control joint clips 66 were at the same height.

Applicant's improved screed guide/control joint is intended to be utilized with the mounting method as set forth in U.S. Pat. No. 8,925,259, and the aforesaid patent's teachings are incorporated by reference as if set forth at length and in detail. Applicant's improved screed guide/control joint provides advantages as set forth in the objects of the invention. Its improved design as well as the clip design allows a clip to accommodate a screed guide of either large or small size eliminating multiple inventory. It further provides for use of an interlocking elevated cap or extension profile for use with stamped concrete and exposed aggregate applications.

Figure 4:
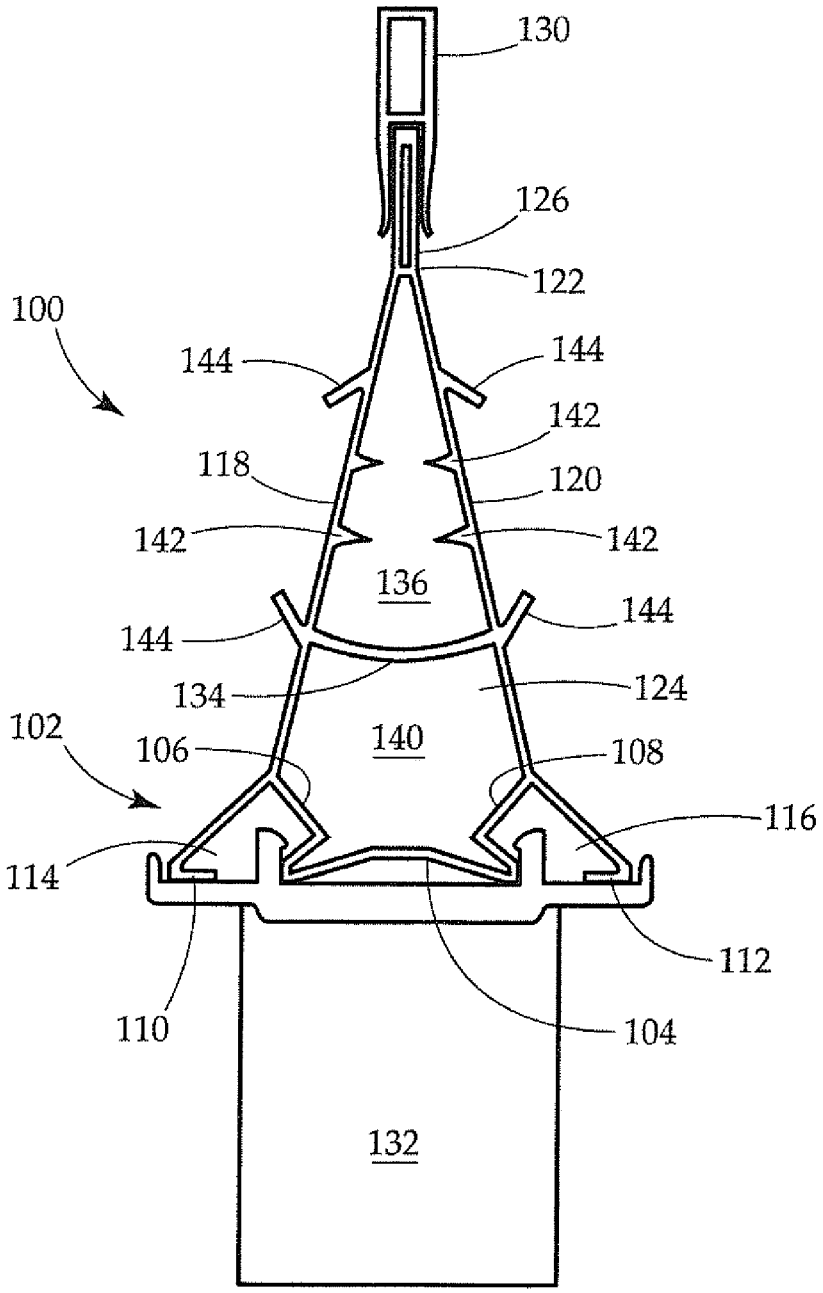
FIG. 4 is an end profile view of the improved screed guide/control joint of the present invention.

FIG. 4 is an end view of a large profile screed guide/control joint of the present invention. The large profile screed guide/control joint 100 is a linear shape normally extending anywhere from 12 to 16 feet and is extruded polymer. It normally is cut to desired lengths in the field, or it is abutted against identical screed guide/control joints 100 to provide for an extended linear screed guide/control joint for the pouring of concrete.

The screed guide/control joint 100 is generally pyramidal or triangular in cross section, and has an irregularly shaped base member 102 having a central arcuate member 104, with unitary S-shaped side walls 106 and 108 which extend outwardly and curve downwardly terminating in an inwardly extending flange 110 and 112 positioned in the same plane as the central arcuate member 104's lowest point and defining two parallel longitudinal open channels 114 and 116. The open channels permit flexibility of base member 102 for ease of fit to a mounting clip.

Two upstanding angular walls 118 and 120 extend upwardly from the base member 102, the angled upstanding vertical walls are joined at an apex 122 forming a generally triangular shaped longitudinal cavity 124, the apex 122 joinder of the two upstanding angled side walls 118 and 120 extending further with vertical member 126 from the apex 122.

Figure 5:
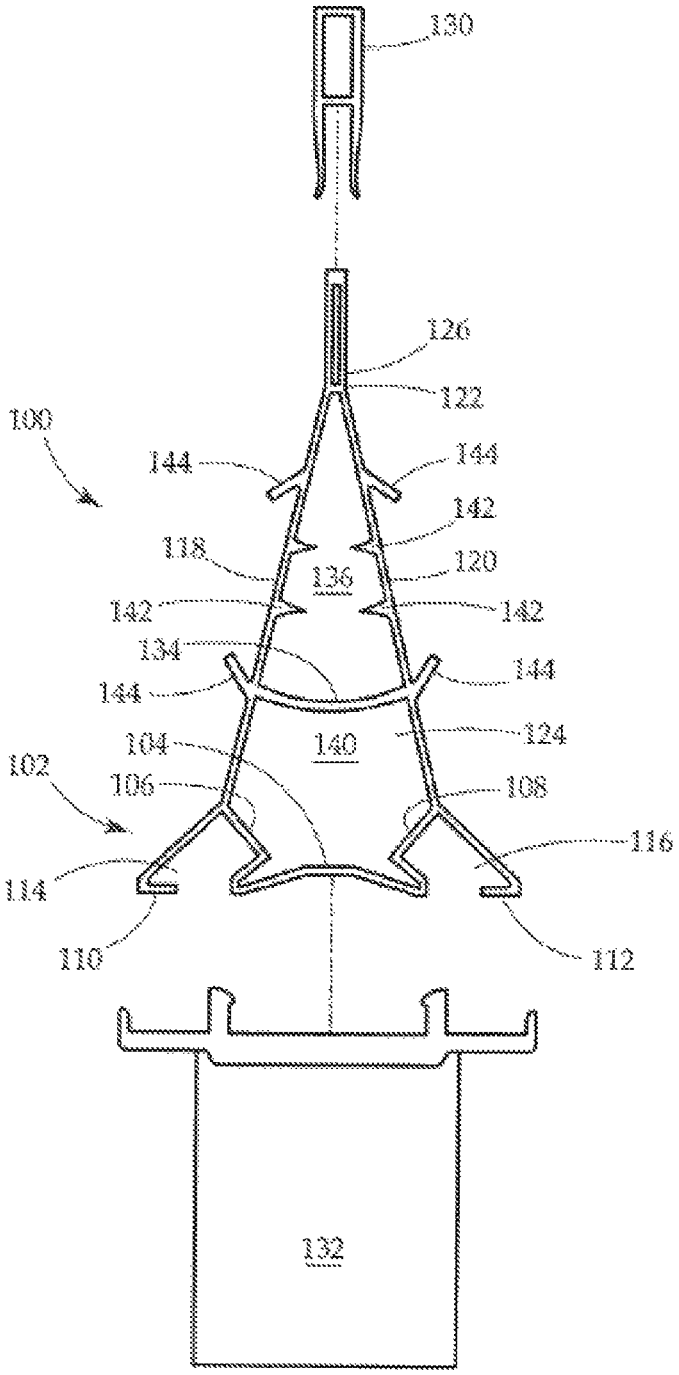
FIG. 5 is an exploded end view of the improved screed guide/control joint of the present invention with mounting clip and removable elevating cap.

As best illustrated in FIG. 5, which is an exploded perspective view of the screed guide/control joint 100 of the present invention, there is a snap fit removable, longitudinal cap member 130 which can be fitted over the vertical joinder extension member 126 of the angled side walls 118 and 120 providing a removable height extension. FIG. 5 also illustrates a clip member 132, utilized in adjusting the height of the screed guide/control joints 100 depending upon the thickness of the slab of concrete which is to be laid. The clip 132 has an improved mounting surface 133 over that which is described in U.S. Pat. No. 8,925,259.

The triangular cavity portion 124 formed by the angular vertical side walls 118 and 120 and the base member 102, is bifurcated by a substantially horizontal wall 134 running the longitudinal length of the screed guide/control joint 100, the substantially horizontal bifurcation wall 134 dividing the cavity 124 into an upper chamber 136 and a lower chamber 140. The upper chamber 136 is further formed with a plurality of inwardly depending longitudinal flanges or tabs 142. These flanges or tabs 142 are designed to stabilize different diameter sized steel rods or rebar commonly used in the laying of concrete. Sections of these steel rods or rebar are frequently used to abut adjoining screed guide/control joints 100. A portion of a steel rod or rebar is inserted into the upper cavity 136 at one end of the screed guide/control joint 100 and is frictionally engaged and maintained by the inwardly depending flanges or tabs 142. An opposing end of the rebar would be slidably frictionally inserted into an abutting screed guide/control joint 100, so that the screed guide/control joint ends could be pushed together and held in abutting relationship. The lower cavity 140 of screed guide/control joint 100 can be utilized as a cavity for the running of conduit, be it electrical, or in some cases a fluid conduit when it is desired to have a heated slab of concrete.

Formed on the exterior surface of the angled upstanding vertical side walls 118 and 120, are a pair of outwardly extending winglets or tabs 144. The lower pair of winglets and tabs as illustrated in FIGS. 4 and 5, extend outwardly and are angled slightly upwardly, whereas the upper winglets or tabs 144 are extended outwardly and downwardly. The exterior winglets 144 are designed to provide better adherence to the surrounding concrete when poured, and to improve the lateral flexibility of the screed guide/control joint 100 during the expansion and contraction process undergone by concrete slabs. They also provide to some extent a water stop function which would impede the growth of flora, such as weeds, from growing and maturing within the control joints.

The removable snap fit cap 130 which can be slidably inserted over the vertical portion 126 of the screed guide/control joint 100 extending upwardly from the apex 122 of the vertical angled side walls 118 and 120, serves two purposes.

The removable cap 130 is initially placed on the screed guide/control joint during the pouring process and is removed immediately thereafter which provides for a recessed control joint below the level of the concrete and which is nearly invisible and provides for a more aesthetic surface of the poured concrete. When removably secured, it allows mats which are used for stamping designs into the concrete to lay flat over the just placed concrete for such stamping.

Figure 6:
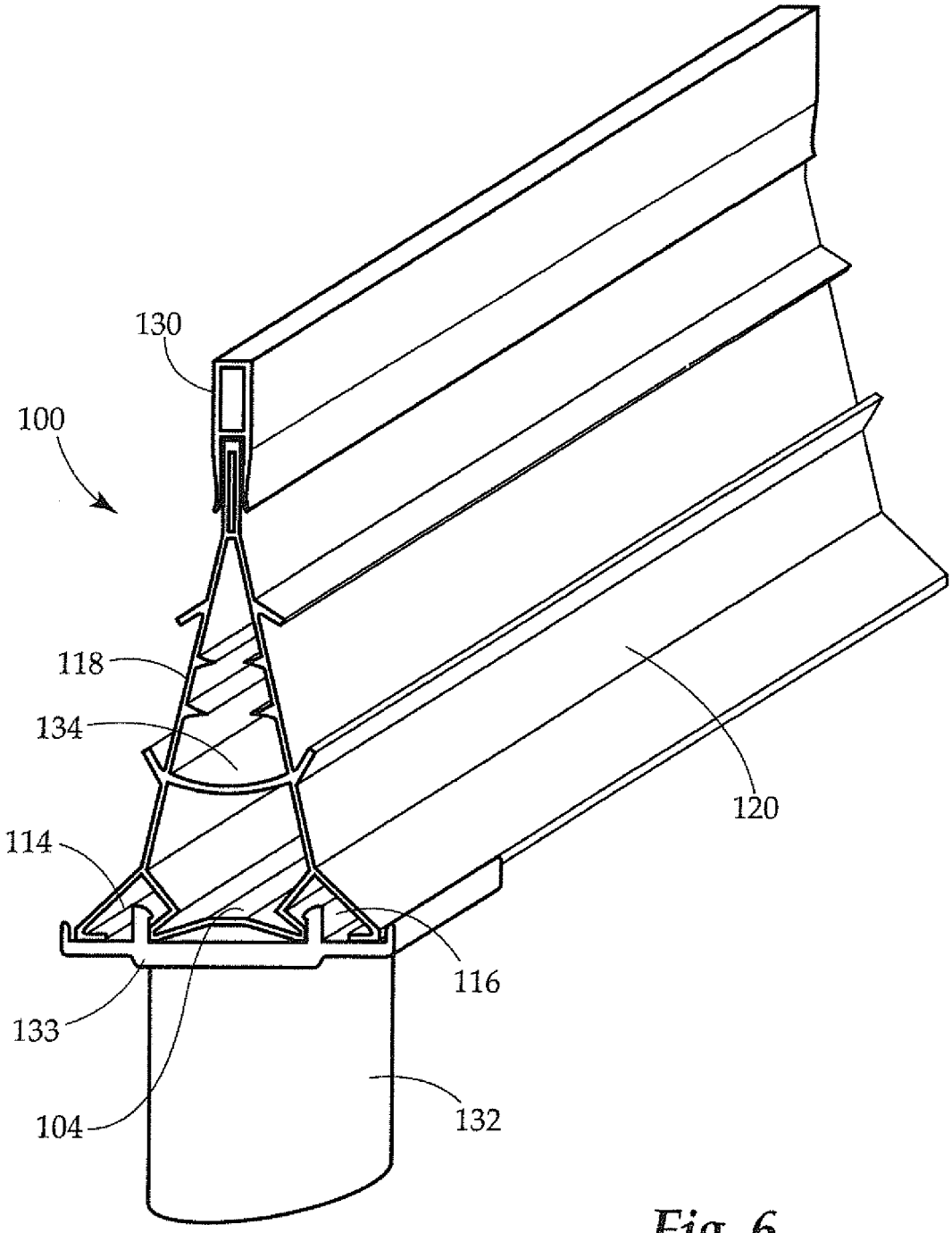
FIG. 6 is a perspective view of the improved screed guide/control joint of the present invention secured to a mounting clip and showing the elevating cap snapped into place.

FIG. 6 is a perspective view of the large profile screed guide/control joint 100 of the present invention illustrated in a snap fit relationship with an improved clip 132 and mounting surface 133. The unique design of the base member 102 of the large profile screed guide/control joint 100 allows for it to be snap fit onto the mounting surface 133 of improved support clip 132 and maintained in the position during the pouring process.

Figure 7:
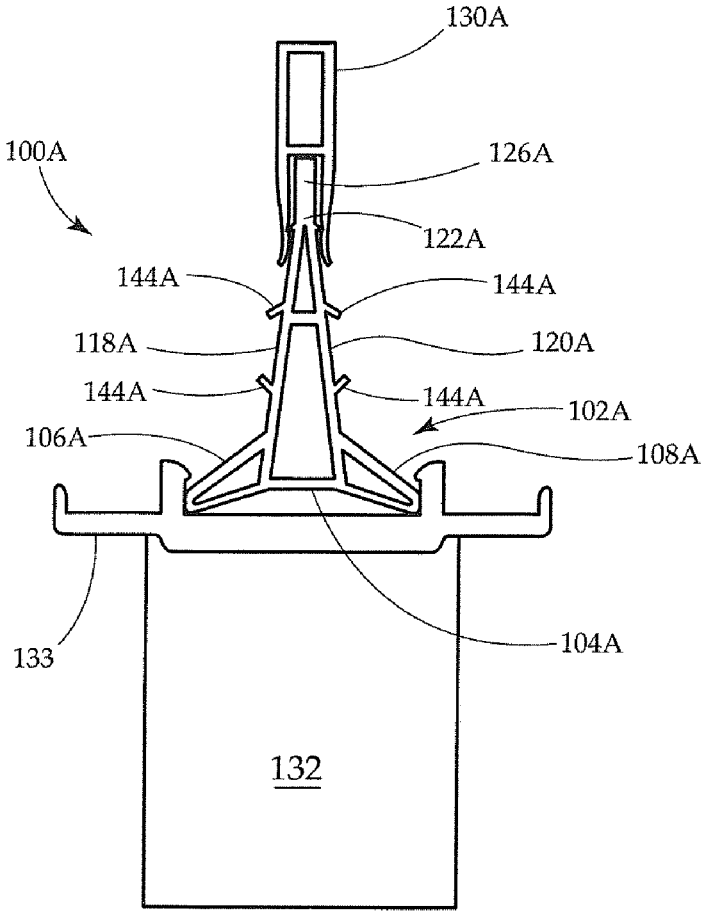
FIG. 7 is an end profile view of a small profile improved screed guide/control joint for use with shallower concrete pours.

FIG. 7 is an end profile of a smaller size improved screed guide/control joint 100A for use with shallower concrete pours. The screed guide/control joint 100A in the low profile is again linear in shape normally extending anywhere from 12 to 16 feet, and is formulated from extruded polymer. The screed guide control joint 100A is of a general pyramidal or triangular cross section having a base member 102A having a central arcuate base member 104A. Unlike the large profile screed guide/control joint 100, the small profile has no extending flanges which form open channels 114 and 116. The arcuate central base member 104A of the base member 102A transitions to a closed flange having an upward slope 106A and 108A, which in turn transitions into upstanding angular walls 118A and 120A extending upwardly and being joined at an apex 122A forming a generally triangular shaped longitudinal cavity 124A. The angled walls 118A and 120A merge at an apex and extend further vertically 126A from the apex 122A.

Removably secured to vertical member 126A of small profile screed guide/control joint 100A is a snap fit, removable, longitudinal cap member 130A similar to the identical cap member associated with the large profile screed guide/control joint.

Formed on the exterior surface of the angled upstanding side walls 118A and 120A are a plurality of outwardly extending winglets or tabs 144A which extend longitudinally with the screed guide/control joint 100A. These exterior winglets 144A serve the same purpose as those winglets described in reference to the large profile screed guide control joint 100.

Figure 8:
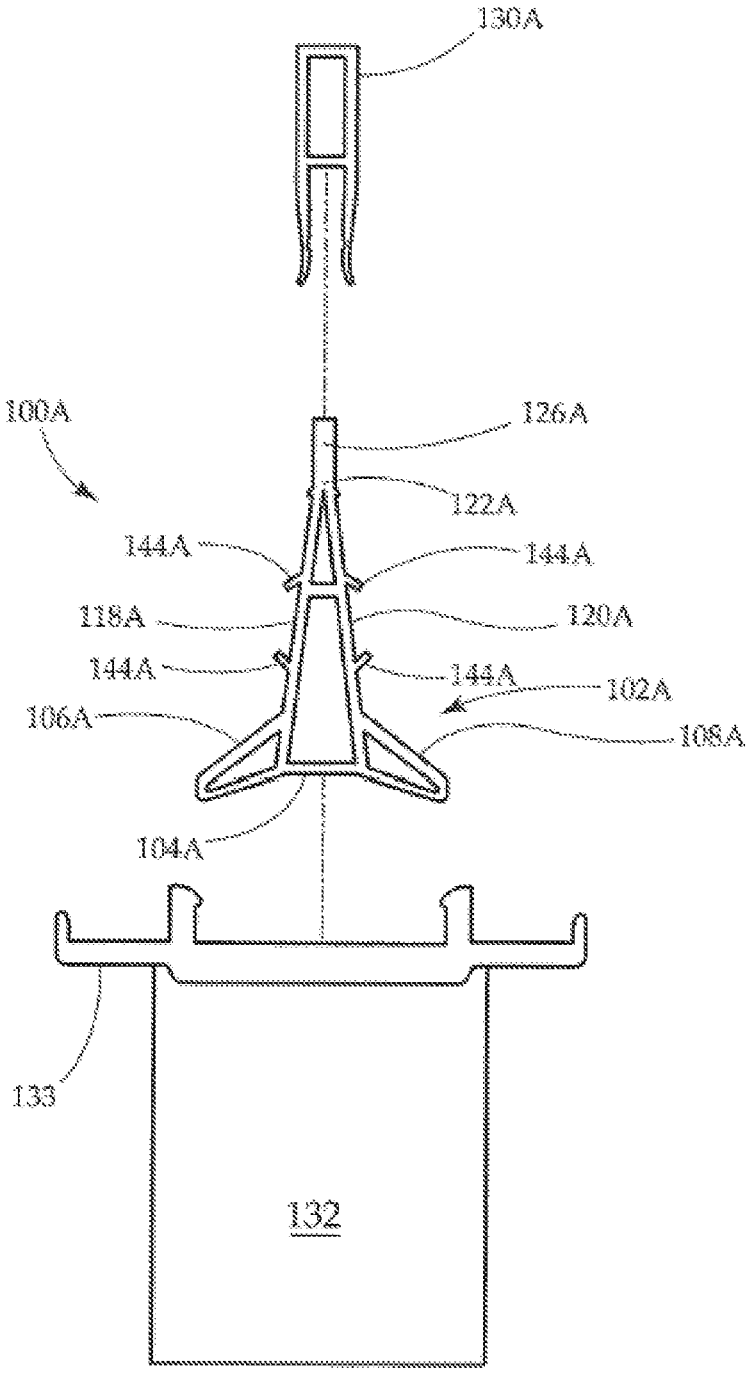
FIG. 8 is an exploded end view of the smaller profile improved screed guide/control joint of FIG. 7.

FIG. 8 is an exploded end view of the small version screed guide/control joint 100A on the improved mounting clip 132. The small profile screed guide/control joint 100A utilizes only the central channel of the support portion of the improved mounting clip 132 for positioning and stabilizing the screed guide/control joint 100A and for adjustment of height. The outer channels of the improved mounting clip 132 are not utilized for mounting the small profile screed guide/control joint 100A, but only the large profile screed guide/control joint 100.

Figure 9:
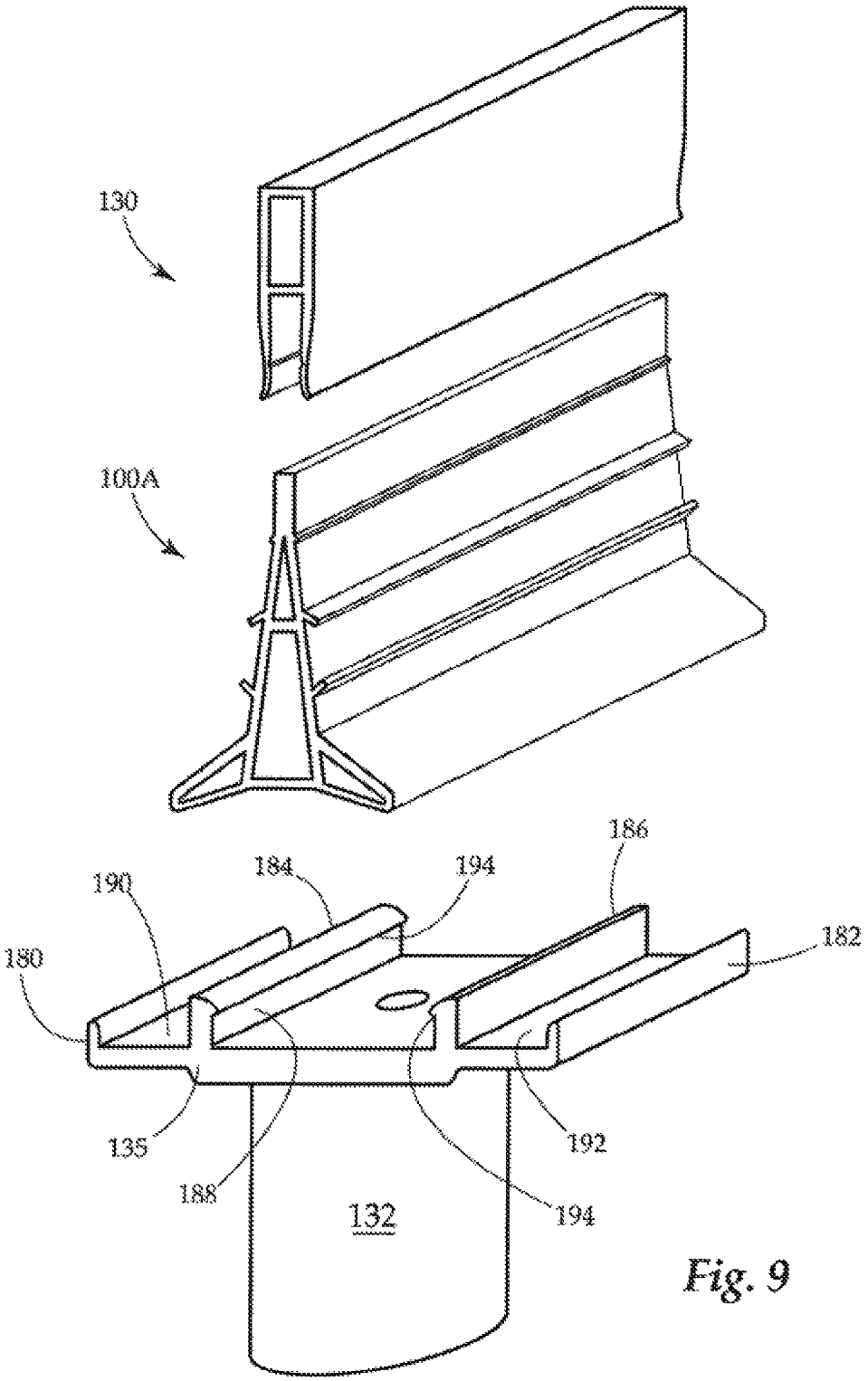
FIG. 9 is a perspective exploded view of the smaller profile screed guide/control joint illustrating details of the mounting clip of FIGS. 4-8.
Figure 10:
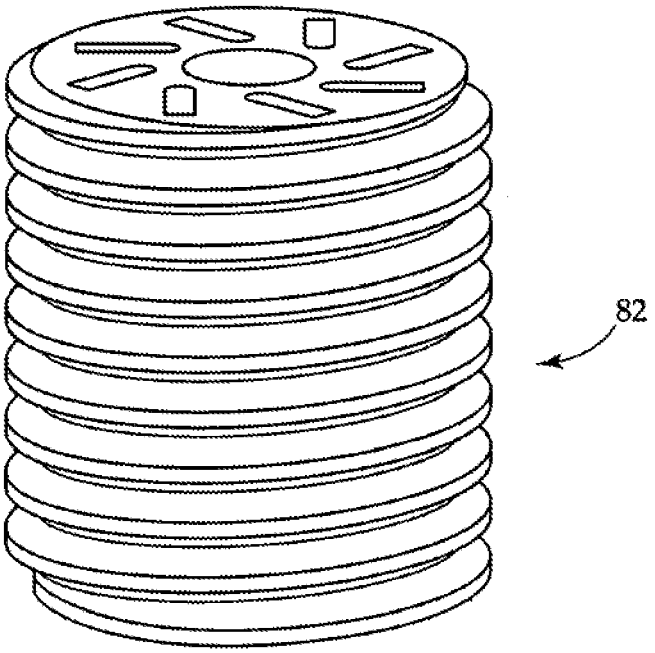
FIG. 10 is a perspective exploded view of an exteriorly threaded tubular cap member.
Figure 11:
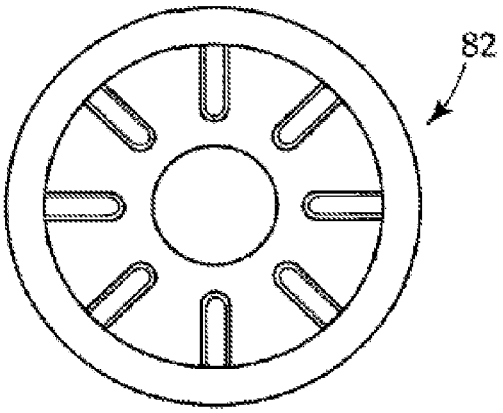
FIG. 11 is a bottom view of the tubular cap member of FIG. 10.

FIG. 9 is a perspective view of the screed guide/control joint of FIG. 8. The mounting clip 132 is the same as illustrated in FIGS. 5, 6, 7, and 8, and illustrates the structure of mounting surface 133. The improvement of the clip 132 deals with the mounting surface 133 atop the tubular portion of mounting clip 132. The mounting portion 133 is substantially planar having four upstanding parallel wall or ridge members, outer wall members 180 and 182, and inner wall members 184 and 186. The interior wall members 184 and 186 are slightly higher than the end wall members 180 and 182, and the interior walls are capped with longitudinal inwardly extending flange members 194. The four upstanding walls define three channels, central channel 188, and side channels 190 and 192. With reference back to FIGS. 6 and 7, the improved mounting clip 132 serves to snap fit engage the main body base member portion 104 of the large profile screed guide/control joint 100 in central channel 188 with the internal flanges 194 on interior walls 184 and 186 forming a snap fit arrangement with the lower profile of the large screed guide/control joint 100, and the flange portions of the large profile of the screed guide/control joint 100 are fitted into the side channels 190 and 192 of the mounting surface 133 of the clip 132.

The improved support clip 132 provides a facile means of adjusting the height of the screed guide/control joint 100 in the manner explained in the '239 patent and insuring that the height chosen is consistent and uniform throughout the longitudinal length or run of the screed guide/control joint 100 and/or abutting screed guide/control clips 100.

FIG. 9 illustrates the small profile screed guide/control joint 100A engaged with the improved clip 132 wherein the lower portion 104A of the small profile screed guide/control joint 100A engages solely with the central channel 188. This structure allows for a single clip 132 to accommodate both the large profile and the small profile screed guide/control joints, and eliminates the need to carry excess inventory with respect to clips to accommodate both. It further simplifies the clip design.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An assembly for the placement of concrete, comprising:

a clip member having a tubular base, said tubular base having a unitarily formed surface support member positioned on a top end thereof, said surface support member being planar, and having four upstanding parallel protruding walls defining a central channel and a first and second outer channels on said surface support member, said four upstanding parallel walls defining the central channel having inwardly facing flanges at an upper edge;

a large-profile screed guide, suitable for use in the placement of concrete slabs of a depth superior or equal to six inches; and a small-profile screed guide, suitable for use in the placement of concrete slabs of a depth inferior to six inches, each of the large-profile and small-profile screed guide having a linear shape and comprising: a base member, and two side walls extending upwardly from the base member and joined at an apex, forming a generally triangular-shaped longitudinal cavity, the large-profile screed guide comprising unitary side walls which extend outwardly from a central member and curve downwardly, each side wall terminating in an inwardly extending flange, thereby defining two parallel longitudinal open channels, wherein the assembly is dimensioned so that the central channel of the clip member is able to snap-fittingly receive the central member of the large-profile screed guide, whereas each of the first and second outer channels of said clip member is able to snap-fittingly receive the inwardly extending flange of one of the side walls of said large-profile screed guide, and the central channel of the clip member is able to snap-fittingly receive the base member of the small-profile screed guide, the clip member receiving either the large-profile or the small-profile screed guide.

2. The assembly of claim 1, wherein the small-profile screed guide has an internal cross rib extending between internal surfaces of the side walls, said small-profile screed guide also having a plurality of stabilizing tabs extending outwardly from an exterior surface of said side walls.

3. The assembly of claim 1, wherein the small-profile screed guide includes a vertical portion extending upwardly from the apex of the side walls, and a removable cap member snap-fitted over said vertical portion.

4. The assembly of claim 1, wherein the large-profile screed guide has a cross rib member defining upper and lower longitudinal channels within said large-profile screed guide, and defined by the converging side walls, said upper interior channel having a plurality of inwardly extending friction tabs suitable for frictional engagement with a section of rebar, said large-profile screed guide also having outwardly extending stabilizing tabs on an exterior surface of said side walls.

5. The assembly of claim 4, wherein the large-profile screed guide includes a vertical portion extending upwardly from the apex of the side walls, and a removable cap member snap-fitted over said vertical portion.

6. The assembly of claim 1, further comprising an exteriorly threaded tubular cap member having a plurality of internal ribs, said exterior threaded cap member being frictionally engageable with an upstanding end portion of rebar, the tubular base of the clip member being engageable with said exterior threaded cap member.

7. The assembly of claim 6, wherein the clip member is rotatably adjustable on the exteriorly threaded tubular cap member for adjustment of height of said clip member for receipt of a large-profile or small-profile screed guide.

8. A method for the placement of concrete using an assembly that includes i) a clip member having a tubular base, said tubular base having a unitarily formed surface support member positioned on a top end thereof, said surface support member being planar, and having four upstanding parallel protruding walls defining a central channel and a first and second outer channels on said surface support member, said four upstanding parallel walls defining the central channel having inwardly facing flanges at an upper edge, ii) a large-profile screed guide, suitable for use in the placement of concrete slabs of a depth superior or equal to six inches, and iii) a small-profile screed guide, suitable for use in the placement of concrete slabs of a depth inferior to six inches, each of the large-profile and small-profile screed guide having a linear shape and comprising: a base member, and two side walls extending upwardly from the base member and joined at an apex, forming a generally triangular-shaped longitudinal cavity, the large-profile screed guide comprising unitary side walls which extend outwardly from a central member and curve downwardly, each side wall terminating in an inwardly extending flange, thereby defining two parallel longitudinal open channels, wherein the assembly is dimensioned so that the central channel of the clip member is able to snap-fittingly receive the central member of the large-profile screed guide, whereas each of the first and second outer channels of said clip member is able to snap-fittingly receive the inwardly extending flange of one of the side walls of said large-profile screed guide, and the central channel of the clip member is able to snap-fittingly receive the base member of the small-profile screed guide, and iv) an exteriorly threaded tubular cap member having a plurality of internal ribs, said exterior threaded cap member being frictionally engageable with an upstanding end portion of rebar, the tubular base of the clip member being rotatably engageable with said exterior threaded cap member, wherein the clip member is rotatably adjustable on the exteriorly threaded tubular cap member for adjustment of height of said clip member for receipt of a large-profile or small-profile screed guide, said method comprising the steps of:

positioning upstanding pieces of rebar in an aligned orientation in a substrate to be overlaid with concrete;

positioning the exteriorly threaded tubular cap member having a plurality of internal ribs in frictional engagement with an upper portion of each upstanding piece of rebar;

securing the clip member to said exteriorly threaded tubular cap member;

rotating said clip member on said exteriorly threaded tubular cap member to achieve equivalent heights of all said clip members secured to said exteriorly threaded cap members on said piece of rebar;

snap-fitting the base member of either one of the large-profile screed guide or the base member of the small-profile screed guide into each of said clip members; and pouring said concrete onto said substrate to the height of an upper edge of said screed guide.

9. The method of claim 8, wherein the large-profile or small-profile screed guide includes a vertical portion extending upwardly from the apex of the side walls, and a removable cap member snap-fitted over said vertical portion.

10. The method if claim 9, further comprising the step of removing the cap member immediately after the pouring step, providing a recessed control joint below the level of the concrete.

11. The method of claim 8, wherein, the step of snap-fitting the base member, snap fits the base member of the large-profile screed guide into each of said clip members, and the step of pouring said concrete onto said substrate to the height of an upper edge of said screed guide includes placement of the concrete to a depth superior or equal to six inches.

12. The method of claim 8, wherein, the step of snap-fitting the base member, snap fits the base member of the small-profile screed guide into each of said clip members, and the step of pouring said concrete onto said substrate to the height of an upper edge of said screed guide places the concrete to a depth inferior to six inches.

* * * * *